US012600914B2

(12) United States Patent
Kettunen et al.

(10) Patent No.: US 12,600,914 B2
(45) Date of Patent: Apr. 14, 2026

(54) METHOD OF TREATING WASTE PLASTIC

(71) Applicant: Neste Oyj, Espoo (FI)

(72) Inventors: Mika P. Kettunen, Porvoo (FI); Eija Koivusalmi, Porvoo (FI); Ville Paasikallio, Porvoo (FI); Pekka Aalto, Porvoo (FI)

(73) Assignee: NESTE OYJ, Espoo (FI)

( * ) Notice: Subject to any disclaimer, the term of this patent is extended or adjusted under 35 U.S.C. 154(b) by 105 days.

(21) Appl. No.: 18/580,240

(22) PCT Filed: Jul. 18, 2022

(86) PCT No.: PCT/FI2022/050501

§ 371 (c)(1),
(2) Date: Jan. 18, 2024

(87) PCT Pub. No.: WO2023/002092

PCT Pub. Date: Jan. 26, 2023

(65) Prior Publication Data

US 2024/0309281 A1 Sep. 19, 2024

(30) Foreign Application Priority Data

Jul. 19, 2021 (FI) ..... 20215816

(51) Int. Cl.
*C10G 65/12* (2006.01)

(52) U.S. Cl.
CPC ..... *C10G 65/12* (2013.01); *C10G 2300/1003* (2013.01); *C10G 2300/4006* (2013.01);
(Continued)

(58) Field of Classification Search
CPC ..... C10G 65/12; C10G 2300/1003; C10G 2300/4006; C10G 2300/4012;
(Continued)

(56) References Cited

U.S. PATENT DOCUMENTS 6,190,542 B1 2/2001 Comolli et al.
8,404,912 B1 3/2013 Miller
(Continued)

FOREIGN PATENT DOCUMENTS

CN 106520168 A 3/2017
EP 3081623 A1 10/2016
(Continued)

OTHER PUBLICATIONS

Joo eta I., Continuous upgrading of a plastics pyrolysis liquid to an environmentally favorable gasoline range product, Apr. 22, 1998, Fuel Processing Tech 57(1998)25-40 (Year: 1998).*
(Continued)

*Primary Examiner* — Cephia D Toomer
(74) *Attorney, Agent, or Firm* — Buchanan Ingersoll & Rooney PC

(57) ABSTRACT

A method of upgrading liquefied waste plastic (LWP) to a mixture of purified hydrocarbons is hereby provided. The method includes the steps of providing a feed including liquefied waste plastic (LWP) and a vacuum gas oil (VGO) stream and/or a heavy gas oil (HGO) stream to form a mixed stream, subjecting the mixed stream to hydrotreatment for removal of impurities and to produce a hydrotreated stream, subjecting the hydrotreated stream to hydrocracking to produce a hydrocracked stream including a mixture of purified hydrocarbons and fractionating the hydrocracked stream.

14 Claims, 1 Drawing Sheet

(52) U.S. Cl.
CPC ..... *C10G 2300/4012* (2013.01); *C10G 2300/4018* (2013.01); *C10G 2300/70* (2013.01)

(58) Field of Classification Search
CPC ..... C10G 2300/4018; C10G 2300/70; C10G 2300/202; C10G 3/50; C10G 9/36; C10G 45/08; C10G 45/58; C10G 47/10; C10G 2300/1074; C10G 1/10; C10G 47/02; C10G 1/002; C08J 11/04; C10L 1/00
See application file for complete search history.

(56) References Cited

U.S. PATENT DOCUMENTS

| | | | | |
|---|---|---|---|---|
| 10,246,643 | B2 | 4/2019 | Gephart et al. | |
| 12,404,458 | B2 * | 9/2025 | Timken | C10G 1/10 |
| 12,415,958 | B2 * | 9/2025 | Timken | C10G 1/002 |
| 2009/0151233 | A1 | 6/2009 | Miller | |
| 2011/0020190 | A1 | 1/2011 | Miller | |
| 2016/0264880 | A1 | 9/2016 | Narayanaswamy et al. | |
| 2016/0362609 | A1 * | 12/2016 | Ward | C10G 69/02 |
| 2021/0189250 | A1 * | 6/2021 | Timken | C10G 9/36 |
| 2022/0041940 | A1 * | 2/2022 | Pradeep | C10G 11/182 |
| 2022/0267679 | A1 * | 8/2022 | Bitting | C10L 1/02 |

FOREIGN PATENT DOCUMENTS

| | | | | |
|---|---|---|---|---|
| EP | 3110912 | A1 | 1/2017 | |
| EP | 3878926 | A1 * | 9/2021 | C10G 1/10 |
| JP | 2015519443 | A | 7/2015 | |
| JP | 2017512246 | A | 5/2017 | |
| WO | 2015128033 | A1 | 9/2015 | |
| WO | 2018058172 | A1 | 4/2018 | |
| WO | 2020020769 | A1 | 1/2020 | |
| WO | 2020129020 | A1 | 6/2020 | |
| WO | 2021105326 | A1 | 6/2021 | |
| WO | 2021105387 | A1 | 6/2021 | |

OTHER PUBLICATIONS

International Search Report (PCT/ISA/210) and Written Opinion (PCT/ISA/237) mailed on Oct. 10, 2022 by the European Patent Office as the International Searching Authority for International Application No. PCT/FI2022/050501. (11 pages).

Karagöz, Selhan, et al., "Catalytic and thermal degradation of high-density polyethylene in vacuum gas oil over non-acidic and acidic catalysts", Applied Catalysis A: General, Amsterdam, NL, Mar. 30, 2003, vol. 242, pp. 51-62, Elsevier Science B.V. (12 pages).

Müller-Hagedorn, Matthias, et al., "Feedstock Recycling of Plastics", selected papers presented at the third International Symposium on Feedstock Recycling of Plastics, Universitätsverlag Karlsruhe, DE, Sep. 25-29, 2005. (608 pages).

Notification of Transmittal of the International Preliminary Report on Patentability (PCT/IPEA/416) dated Oct. 10, 2023 issued in corresponding International Patent Application No. PCT/FI2022/050501. (17 pages).

Search Report dated Nov. 1, 2021 issued by the Finnish Patent and Registration Office in corresponding Finnish Patent Application No. 20215816. (2 pages).

Office Action (Notice of Reasons for Rejection) issued on Sep. 30, 2025, by the Japanese Patent Office in corresponding Japanese Patent Application No. 2024-503480, and an English Translation of the Office Action. (4 pages).

Search Report issued on Nov. 20, 2025, by the Chinese Patent Office in corresponding Chinese Application No. 2022800552565 and an English Translation. (4 pages).

* cited by examiner

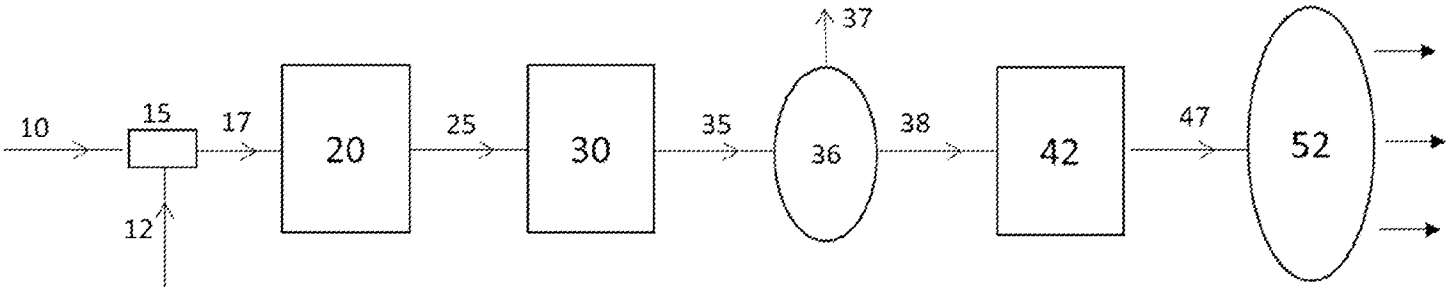
10
15
12
17
20
25
30
35
36
37
38
42
47
52

METHOD OF TREATING WASTE PLASTIC

FIELD OF THE INVENTION

The present invention relates to a method of upgrading waste or recycled plastics. In particular the invention relates to a method of producing a mixture of purified hydrocarbons, where the hydrocarbons are especially suitable as base oil components. Provided is therefore a method in which a mixture of purified hydrocarbons is produced from liquefied waste plastic (LWP) and a vacuum gas oil (VGO)/heavy gas oil (HGO) feed.

BACKGROUND OF THE INVENTION

Environmental concerns and a wish to limit the use of fossil based feedstock leads to a need to develop possibilities to use waste plastic. Waste plastic is a growing environmental concern, since many of the polymers constituting the plastics are very stable and do not degrade in nature. Incineration of waste plastic increases greenhouse gases and also leads to other environmental concerns in the form of air and land pollution. Incineration of waste plastic is largely considered a waste of valuable raw material, even if the energy in form of heat is collected.

Plastics or polymers mainly constitute carbon, hydrogen and heteroatoms such as oxygen and/or nitrogen. However, waste plastics also contain many impurities from other sources, such as metal and chlorine impurities. There is a growing interest in making use of waste plastic for producing various hydrocarbon components. Fuels are mixtures of hydrocarbons, but production of liquid fuels from waste plastic is generally not considered useful. Direct incineration of waste plastic also produces energy, which can be captured and used for heating and/or production of electricity etc. Therefore, there is a need to upgrade waste plastic to high end hydrocarbon components, which can be utilized in the production of new plastics, chemicals or other materials.

Base oils used for lubrication and other purposes are a potential hydrocarbon product from waste plastic. However, there are high demands on the properties of base oils, especially regarding viscosity and cold flow properties. Base oils are divided into separate groups based on their properties and potential uses.

Publication EP3081623 describe a method of producing oil-based components, the method comprising providing vacuum gas oil (VGO) and wax as a minor component in the feed and subjecting the feed to hydrocracking and further subjecting a bottom fraction to a dewaxing step to provide base oil and middle distillate.

A process for producing hydrocarbon oil from thermal decomposition of waste plastics is described in patent publication U.S. Pat. No. 10,246,643. The disclosed process includes melting of waste plastic to remove chlorine and organics, transferring the melted waste plastic into a heated screw pyrolysis reactor, to form hydrocarbon gases, which are condensed and form the hydrocarbon oil.

Liquefied waste plastic (LWP) is a desirable recycled feedstock in various application to replace use of virgin fossil oil feedstock, However LWP still contain impurities which limit the use of a stream comprising LWP as a feedstock, also there is a ever increasing need for base oil components with increased properties.

BRIEF DESCRIPTION OF THE INVENTION

An object of the present invention is to provide a method and a purified hydrocarbon product to overcome the above problems. The objects of the invention are achieved by a method and an arrangement which are characterized by what is stated in the independent claims. The preferred embodiments of the invention are disclosed in the dependent claims.

Therefore, an object of the current invention is to provide a method of upgrading liquefied waste plastic (LWP) to a mixture of purified hydrocarbons, the method comprising:

- providing a feed comprising liquefied waste plastic (LWP) and a vacuum gas oil (VGO) stream and/or a heavy gas oil (HGO) stream to form a mixed stream,
- subjecting said mixed stream to hydrotreatment for removal of impurities and to produce a hydrotreated stream,
- subjecting the hydrotreated stream to hydrocracking to produce a hydrocracked stream comprising a mixture of purified hydrocarbons
- fractionating the hydrocracked stream comprising a mixture of purified hydrocarbons.

A general advantage of the method of the current invention is that waste plastics can be upgraded to valuable products. Further advantages of the method is that valuable hydrocarbons suitable for production of base oil components and middle distillate fuel components are obtained.

BRIEF DESCRIPTION OF THE DRAWINGS

In the following the invention will be described in greater detail by means of preferred embodiments with reference to the attached drawing, in which FIG. 1 shows a schematic view of a specific embodiment of the invention.

DETAILED DESCRIPTION OF THE INVENTION

The current invention relates to a method for producing a mixture of purified hydrocarbons from a feed comprising liquefied waste plastic (LWP) and a vacuum gas oil (VGO) and/or heavy gas oil (HGO) stream(s). With the term "liquefied waste plastic" is hereby meant a liquid product produced from any waste plastic through a non-oxidative thermolysis process. Typically, liquefied waste plastic is produced by pyrolysis of waste plastic. The LWP is a mixture of hydrocarbonaceous organic components with a wide range of carbon chain lengths. The carbon chain lengths and chemical structure and thereby the properties of the LWP varies depending on types of plastics (polymers) used in the production and the liquefaction conditions. Typical waste plastic feedstock for the liquefaction method includes mainly polyethylene with varying amounts of polypropylene, polystyrene and other minor components such as polyamides, polyethylene terephthalate and polyvinyl chloride.

In one embodiment of the current invention the liquefied waste plastic is obtained by pyrolyzing waste plastic and subsequently fractionating the pyrolyzed waste plastic, wherein the bottom heavy fraction of the fractionation constitutes the liquefied waste plastic feed of the current method. The LWP typically has a boiling range of about 40° C.-550° C., which corresponds approximately to carbon chain lengths of C5 to C55. Depending on the conversion technology, the final boiling point of the LWP can go up to 750° C.

LWP is a thermal cracking product of various polymers and is a complex mixture of mainly paraffins, olefins, naphthenes and aromatic hydrocarbons. The total amount of olefins is typically high, from 40 wt. % to 60 wt. %, whereas the amount of aromatic hydrocarbons is typically lower than 20 wt. %. LWP also contains heteroatoms, including oxygen, nitrogen, chloride and sulphur, in the form of organic compounds with heteroatom substituents. The amounts of heteroatoms vary depending on the polymers used in production of LWP. Water is usually removed from the LWP product, but some dissolved water may still be present in the LWP.

The liquefied waste plastic can also undergo pre-treatment processes before the hydrotreatment according to this invention.

The feed to be subjected to hydrotreatment also comprises a vacuum gas oil (VGO) stream. With the term "vacuum gas oil stream" or "VGO" stream is here meant a stream of heavy oils, which are recovered as distillates from an oil refinery vacuum distillation unit. In addition, or as an alternative to VGO, the feed to be subjected to hydrotreatment can also comprise heavy gas oil (HGO), which has similar properties as VGO, but is obtained from atmospheric crude oil distillation rather than vacuum distillation. From here onwards, the stream comprising VGO and/or HGO will be referred to as "VGO/HGO stream".

The VGO/HGO stream contains a large quantity of cyclic and aromatic compounds as well as heteroatoms, such as sulphur and nitrogen, and other heavier compounds. The exact composition of the VGO/HGO stream varies depending on the crude source used for petroleum distillation and the VGO/HGO cut-off. The term VGO/HGO stream, or more generally the terms VGO and HGO, are well known in petroleum refinery technology. It was surprisingly found that LWP mixed well with a VGO/HGO stream and that mixing LWP with a VGO/HGO stream improved the refining process and the quality of the end-products.

According to one embodiment of the invention the amount of LWP in the total feed of the method according to the invention, is from 1 wt. % to 40 wt. % based on the total feed. Preferably the amount of LWP in the total feed is 5 wt. % to 30 wt. % and more preferably 5 wt. % to 25 wt. %.

The LWP can contain significant amounts of chlorine, in the form of organic or inorganic chlorides, depending on the source of the waste plastic. Chloride containing compounds can be converted into hydrogen chloride (HCl) during refining operations, and HCl is a well known corrodent. Thus, the amount of chloride that is introduced into oil refining processes in conjunction with LWP should be minimized. It was found that mixing the LWP stream with a VGO/HGO stream less pre-treatment was needed before the hydrotreatment and hydrocracking refining process.

In addition, it has surprisingly been found that by using a combination of LWP and VGO/HGO stream, which is subjected to a two-step treatment comprising first hydrotreatment followed by hydrocracking, a mixture of hydrocarbons with excellent viscosity properties can be produced. As it is shown in the examples below, addition of LWP in a VGO/HGO stream, followed by hydrotreating and hydrocracking of the mixture yielded products which had a significantly higher viscosity index compared to products obtained in an identical manner purely from VGO. With the addition of LWP to the VGO/HGO stream a viscosity index of over 130, as is required for API Group III+ base oils, could be achieved even with lower hydrocracking conversion rates.

One skilled in the art will appreciate that the exact composition and properties of VGO and HGO and any mixtures prepared thereof will depend on the type of crude oil that is processed and the overall configuration of the crude oil distillation process (including both atmospheric and vacuum distillation steps). Furthermore, the individual distillation steps may be configured or optimized in a certain manner due to specific requirements originating from the downstream processing units. Nevertheless, VGO and HGO are very similar streams, and therefore one may expect that a similar effect would occur when adding LWP to either of these streams or a mixture thereof.

American Petroleum Institute (API) categorised base oils into five major groups both based on properties and production methods. API Group III is the base oil group obtained from VGO/HGO with the highest requirements for viscosity index. The requirements for viscosity index in Group III is greater than or equal to 120. Even though the Group III+ is not an official API group it is already well established. The viscosity index requirement for Group III+ is greater than or equal to 130.

It was surprisingly found that components, from which high-quality base oils can be produced, could be achieved from LWP, which is typically of low quality compared to many other feeds due to the amounts of impurities contained in the waste plastics. The LWP contains significant amounts of impurities, such as chloride, e.g. in comparison to slack-wax feed. Despite the high amounts of impurities in LWP, high quality components could be obtained by the claimed method. This is achieved even if the bottom fraction after LWP fractionation is used in the feed. The method of the invention is flexible and can easily be modified depending on the quality and properties of the feed.

According to the method of the current invention, the feed comprising LWP and VGO/HGO stream is subjected to hydrotreatment to produce a hydrotreated stream. The hydrotreatment can be performed in conditions where any heteroatoms possible present in the LWP, such as oxygen, sulphur and/or nitrogen are removed. In addition to removal of heteroatoms, the hydrotreatment also results in full or partial saturation of unsaturated compounds (aromatics and olefins), if present. The hydrotreatment is performed on the feed to remove impurities, such as nitrogen, sulphur, halogens and metals, which might be present in feed. It was surprisingly found that by first conducting a hydrotreatment to the feed comprising VGO/HGO and LWP the hydrocracking process is easier to optimise.

The hydrotreatment is typically performed in the presence of a catalyst. The catalyst may, for example, comprise at least one component selected from IUPAC group 6, 8 or 10 of the Periodic Table of Elements. When employing a supported catalyst, the catalyst preferably contains Mo and at least one further transition metal on a support. Examples of such a supported catalyst are a supported NiMo catalyst or a supported CoMo catalyst, or a mixture of both. In a supported catalyst, the support preferably comprises alumina and/or silica. These catalysts are usually employed as sulphided catalysts to ensure that the catalysts are in their active (sulphided) form. Turning the catalysts into their active (sulphided) form may be achieved by sulphiding them in advance (i.e. before starting the hydrotreatment reaction) and/or by adding a sulphur-containing feed (containing sulphur e.g. as an organic or inorganic sulphide). The feed may contain the sulphur from the start, or a sulphur additive may be admixed to the feed. In a preferable embodiment, the hydrotreating employs a catalyst and the catalyst is a supported NiMo catalyst and the support comprises alumina ($NiMo/Al_2O_3$) and/or the catalyst is a supported CoMo catalyst and the support comprises alumina ($CoMo/Al_2O_3$).

The hydrotreatment can be performed by arranging the hydrotreating catalyst(s) in one or more layers in a fixed bed reactor and letting the feed comprising LWP pass through the layers of catalyst(s) together with hydrogen. The catalyst(s) may also be arranged in a graded catalyst bed. Alternatives for suitable catalyst arrangement and conditions for hydrotreatment are well known to a person skilled in the art.

The hydrotreating can be performed using any suitable hydrotreating conditions. In one embodiment of the invention the hydrotreating is performed using the following conditions: a temperature of from 250-450° C., preferably 330-420° and more preferably 390-410° C., the pressure can be 30-250 bar (3-25 MPa), preferably 130-180 bar (13-18 MPa) and more preferably 145-155 bar 14.5-15.5 MPa); a hydrogen to oil ratio of 500-2000 l:l, preferably about 900-1300 l:l and more preferably about 1000-1200 l:l; and a hydrocarbon liquid hourly space velocity (LHSV) of about 0.2 to 10.0 1/h, preferably 1.5 to 2.7 1/h and more preferably 1.8-2.5 1/h.

In one embodiment of the current invention the hydrotreatment comprises the use of at least one guard bed before the actual hydrotreatment. The guard beds can be facilitated to remove impurities such as silicon, phosphorous, chlorides and/or iron.

The hydrotreatment step, optionally including the use of guard beds, has basically two functions, to remove impurities and to saturate double bonds. By removing impurities and saturating the double bonds before the essential hydrocracking stage, the feedstock is normalised, meaning that the hydrotreatment step removes variations in the hydrocracker feed. Thereby, the conditions in the hydrocracker stage can be kept stable and they do not need to be changed with changes in the overall feedstock. The hydrotreatment step, which precedes the hydrocracking, makes sure that hydrocracking conditions can be optimised for production of high-quality hydrocarbons, which can be further converted into base oil components with excellent properties.

The formed hydrotreated stream is subjected to hydrocracking to obtain a mixture of purified hydrocarbons, which is also called a hydrocracked stream. In the hydrocracking step, heteroatoms such as N and S, which have not been removed in the hydrotreatment, are removed. In the hydrocracking mainly larger long-chain hydrocarbons are cleaved into smaller short-chain hydrocarbons and/or some cyclic hydrocarbons are ring-opened to form linear and/or branched hydrocarbons. Hydrocracking is typically performed in the presence of a hydrocracking catalyst. Hydrocracking catalysts suitable for use in this step include but are not limited to bifunctional catalysts comprising an acidic support such as alumina, amorphous silica-alumina or a zeolite and at least one active hydrogenation component selected from IUPAC group 6, 8 or 10 of the Periodic Table of Elements. Examples of typical hydrocracking catalysts include e.g. $NiW/Al_2O_3$, NiW/zeolite, $NiW/Al_2O_3—SiO_2$, Pt/zeolite or Pd/zeolite, and $Pt/Al_2O_3—SiO_2$ or $Pt/Al_2O_3—SiO_2$.

The hydrocracking catalyst(s) may be arranged in one or more layers in a fixed bed reactor. The hydrotreated stream together with hydrogen is directed through the fixed bed with layered hydrocracking catalyst(s) to form a hydrocracked stream. Alternatives for suitable catalyst arrangement and conditions for hydrocracking a hydrotreated stream of hydrocarbons are well known to a person skilled in the art.

The hydrocracking can be performed using any suitable hydrocracking conditions. In one embodiment of the invention the hydrocracking is performed using the following conditions: a temperature of 330-450° C., preferably 370-420° C. and more preferably 390-410° C.; a pressure of 50-250 bar (5-25 MPa), preferably 140-160 bar (14-16 MPa) and more preferably 145-155 bar (14.5-15-5 MPa); a hydrogen to oil ratio of 500-2000 l:l, preferably about 900-1300 l:l and more preferably 1000-1200 l:l; and a hydrocarbon liquid hourly space velocity (LHSV) of about 0.5 to 5.0 1/h, preferably 1.0 to 2.5 1/h and more preferably 1.4 to 1.9 1/h.

The hydrocracking can be followed by removal of light products before further processing. Other treatments such as fractionations are also possible.

The hydrotreatment and hydrocracking steps can be conducted in a single reactor or separate reactors. When these two steps are conducted in separate reactors, the hydrotreatment reactor is arranged immediately upstream of the hydrocracking reactor, without additional process steps between the hydrotreatment and hydrocracking. In one option the hydrotreatment and hydrocracking is performed in one unit, which is arranged in a single vessel, having a hydrotreatment section followed by a hydrocracking section. The unit can also comprise one or more hydrotreatment guard beds before the hydrotreatment section.

The method according to the invention further comprises a step of fractionating the hydrocracked stream comprising a mixture of purified hydrocarbons. If the method further comprises an isomerisation step, then the fractionation step can be performed either before the isomerisation step or after the isomerisation step. The fractionation of the mixture of hydrocarbons formed in the hydrocracking can be performed by typical distillation methods and one or several fractions can be obtained in the distillation. In one embodiment of the invention the mixture of hydrocarbons is subjected to fractionations to obtain at least two fractions, a light fraction and a heavy fraction. Where the heavy fraction comprises hydrocarbons suitable for production of base oil components and the light fraction comprises hydrocarbons suitable for use as fuel components or as feeds for steam cracking and subsequently polymer production.

In another embodiment the fractionation of the mixture of hydrocarbons is performed such to obtain at least three fractions of which a first and a second fraction is heavier fractions comprising hydrocarbons suitable for producing base oil components and a third fraction is a lighter fraction suitable for use as fuel components or as feeds for steam cracking and subsequent polymer production. The first heavier fraction can be a fraction with components having a 5 wt. % distillation point of >380° C. and the second heavier fraction can be a fraction with component having a 5 to 95 wt. % distillation range from 330 to 410° C. and the third fraction suitable for use as fuel components or as feeds for steam cracking and subsequent polymer production having a boiling point distribution that is lighter than the aforementioned first and second heavier fractions and has a 95 wt. % distillation point of <370° C.

According to one embodiment of the invention the method further comprises hydroisomerisation of the mixture of hydrocarbons produced by the two-step treatment comprising first hydrotreatment followed by hydrocracking. The hydrocracked stream of hydrocarbons can be subjected to an isomerisation or a dewaxing step. Alternatively, the fraction(s) collected in the fractionation step after the hydrocracking step, can be subjected to hydroisomerisation.

In the isomerisation step, the straight chain n-paraffins are isomerised to provide branched paraffins, so called isoparaffins (also called i-paraffins). Isomerisation of the n-paraffins or hydrocarbons of the hydrocracked stream is desired and generally improves the cold flow properties of the mixture of hydrocarbons. Isomerisation is generally performed in the presence of an isomerisation catalyst. Isomerisation catalysts and conditions suitable for carrying out this process step is well known by the person skilled in the art.

The isomerisation produces a mixture of hydrocarbons, which can optionally further be fractionated after the isomerisation. The isomerised hydrocarbons can be fractionated by distillation, such that a light fraction is removed from the stream. Rest of the stream, from which the light fraction has been removed, is subjected to further fractionations. A distillation or fractionation step after the isomerisation step is especially useful if the mixture of hydrocarbons obtained after the hydrocracking has not been subjected to a distillation or a fractionation step.

According to one embodiment of the current invention the liquefied waste plastic (LWP) is produced by pyrolysis of a waste plastic. The waste plastic can be any waste plastic but is suitable waste plastic collected for recycling from industrial or municipal sources. Polymer types in the waste plastic include but are not limited to mainly low and high density polyethene and polypropene, but also other polymers can be present in the waste, such as polystyrene, polyamides, polyethylene terephthalate Teflon, etc. The overall preference is to have a maximum amount of polymers comprising only carbon and hydrogen, but depending on the liquefaction process and subsequent downstream operations a varying amount of heteroatom impurities can be tolerated as well.

According to one embodiment of the invention the formed LWP is fractionated preferably by distillation before subjecting the feed to hydrotreatment. In the fractionation of LWP a light fraction is removed from the LWP, and the bottom fraction is collected and forms the feed comprising LWP which is subjected to hydrotreatment and hydrocracking. In an embodiment the formed LWP is also subjected to a pre-treatment process for removal of impurities.

In addition, the current invention also involves a purified hydrocarbon product, which is produced by a method according to the current invention. The purified hydrocarbon product comprises hydrocarbon components with an impurity level suitable for use in steam cracking. Steam cracking is used to produce olefins and other hydrocarbons suitable for polymerisation and production of polymers.

In FIG. 1 a specific embodiment of the current invention is depicted as a schematic process. LWP (10) is mixed together (15) with a VGO/HGO stream (12) to form a feed comprising LWP and VGO/HGO stream. The mixing (15) can be performed in a separate vessel for mixing streams or simply by combining pipes for LWP (10) with the pipe of VGO/HGO stream (12), whereby the mixing takes place in the pipes and hydrotreatment (20). The mixed stream (17) is subjected to hydrotreatment (20). After hydrotreatment (20) a hydrotreated stream (25) is produced, which is subjected to hydrocracking (30). The hydrocracked stream (35) produced in hydrocracking contains a mixture of hydrocarbons. The hydrocracked stream (35) is subjected to a distillation step (36) for separating a light fraction (37) from the hydrocracked stream. The bottom fraction (38) of the distillation step (36) is subjected to isomerisation (42) of the bottom fraction (38). The isomerised bottom fraction stream (47) is a stream comprising a mixture of purified hydrocarbons, and is subjected to further fractionation (52) where various fractions are obtained.

EXAMPLES

Example 1

LWP Production and Distillation

Two separate LWP samples were used in this example for illustration. One was produced from a polyethylene-rich waste plastic feedstock whereas the other one was produced from a polypropylene-rich waste plastic feedstock. The original waste plastic feedstocks were converted in a batch-type pyrolysis process to yield two LWP crude oils. The plastic was loaded into a horizontal kiln-type pyrolysis reactor, which was then gradually heated to approximately 440° C. The pyrolysis process was continued until no visible vapor/gas generation took place. The average reaction temperature was approximately 400° C. The pyrolysis vapours were cooled down and condensed to form the crude LWP samples.

The crude LWP samples were vacuum distilled using a 20 liter batch distillation system and two fractions, namely a naptha range cut (~30° C.-~190° C.) and a middle distillate cut (~165° C.-350° C.) were recovered as distillates. The heavy fraction (>350° C.) was recovered as the distillation bottom product for both LWP samples. The yield of the heavy fraction was 37 wt. % for the PE-rich LWP and 23 wt. % for the PP-rich LWP. The two LWP heavy fractions were mixed in equal proportions (based on weight) before any further processing.

Method and Product Analysis

For illustration a VGO/HGO feed only and a feed containing 90 wt. % of VGO/HGO and 10 wt. % of the LWP heavy fraction were subjected to a method according to the invention, i.e. subjected to hydrotreatment using an alumina-supported transition metal sulfide catalyst ($NiMo/Al_2O_3$) followed by hydrocracking on a typical bifunctional hydrocracking catalyst (NiW on a zeolite support). The conditions, which otherwise were the same for both hydrotreatment (HT) and hydrocracking (HC) steps besides the weight hourly space velocity (WHSV), can be seen in table 1.

The resulting hydrocracking product was analysed using simulated distillation (EN15199-2) to determine the conversion of the >343° C. fraction. Both feeds were hydrocracked at two different conversion levels (60% and 75%) and then physically distilled to different product fractions (185-350° C., 350-405° C. and >405° C.). Subsequently, the 350-405° C. and >405° C. product fractions were subjected to solvent dewaxing with a 50/50 mixture of toluene and methyl ethyl ketone. T he viscosity of the solvent dewaxed product was determined according to ENISO3104, the viscosity index according to ASTM D2270, and the pour point according to ASTM D5950.

The overall product distribution of this experiment, which is presented in Table 1, shows that incorporating 10 wt. % of LWP into the hydrocracking process did not negatively influence the yield of the most desired product fractions, i.e. the >405° C. and the 385-405° C. cuts.

The conversion was calculated at 343° C. cut points (343+° C.) as

Conversion % [343° C.]:

$$100 - [100 * (\text{product boiling} > 343° \text{ C})/ (\text{a fraction in the feed, boiling} > 343° \text{ C})]$$

Conversion therefore denotes the percentage of the feed components that originally have boiling points of >343° C., and are converted into compounds with boiling points of <343° C. during the process. A higher conversion therefore means that more gases and liquid hydrocarbons with boiling points in the naphtha/gasoline/middle distillates range are produced. Consequently, less hydrocarbons that are suitable for production of base oils are produced. The conversion can be primarily influenced by changing the reaction temperature, i.e. increasing the temperature will increase conversion.

TABLE 1

Product distribution from hydrotreating (HT) and hydrocracking (HC) of VGO/HGO only and VGO/HGO + LWP at two different conversion levels.

| Feed | VGO/HGO only | VGO/HGO only | VGO/HGO + LWP | VGO/HGO + LWP |
|---|---|---|---|---|
| T (° C.) | 393 | 399 | 393 | 400 |
| p (bar) | 150 | 150 | 150 | 150 |
| WHSV (1/h) | HT 2.3<br>HC 1.5 | HT 2.3<br>HC 1.5 | HT 2.3<br>HC 1.5 | HT 2.3<br>HC 1.5 |
| Conversion (%) | 60 | 75 | 60 | 75 |
| Product distribution [wt. %] | | | | |
| Gas | 9 | 12 | 11 | 13 |
| C5-180° C. | 14 | 17 | 13 | 17 |
| 180-360° C. | 40 | 43 | 40 | 41 |
| 360-385° C. | 8 | 6 | 7 | 6 |
| 385-405° C. | 8 | 6 | 7 | 6 |
| >405° C. | 22 | 15 | 21 | 15 |

Table 2 shows the properties of the >405° C. fractions after solvent dewaxing. The results clearly show that with the 10 wt. % LWP addition, the viscosity index of the product has increased considerably. When combining this with the fact that the yield of this particular fraction remained practically identical compared to using only VGO/HGO as the feed, it is abundantly clear that the LWP addition is overall beneficial for product quality. One skilled in the art will also appreciate that by processing the LWP-containing feed at lower conversion levels, one can obtain a product with a viscosity index of >130 at higher yields than those reported in Table 1 and Table 2.

TABLE 2

Yield of the >405° C. fraction at different conversion levels with VGO/HGO only and VGO/HGO + LWP, and its properties after solvent dewaxing.

| Feed | VGO/HGO only | VGO/HGO only | VGO/HGO + LWP | VGO/HGO + LWP |
|---|---|---|---|---|
| Conversion (%) | 60 | 75 | 60 | 75 |
| Yield of >405° C. fraction | 22 | 15 | 21 | 15 |
| Viscosity at 40° C. ($mm^2/s$) | 25.6 | 22.3 | 23.6 | 23.3 |
| Viscosity at 100° C. ($mm^2/s$) | 5.0 | 4.7 | 4.8 | 4.8 |
| Viscosity index | 127 | 129 | 140 | 146 |
| Pour point (° C.) | −15 | −15 | −18 | −15 |

In contrast to the situation with the >405° C. fraction, the properties of the 350-405° C. fraction did not exhibit clear changes. As it can be seen in Table 3, the viscosity index after solvent dewaxing was very similar with and without the added LWP.

TABLE 3

Properties of the solvent dewaxed 350-405° C. fraction at different conversion levels with VGO/HGO only and VGO/HGO + LWP.

| Feed | VGO/HGO only | VGO/HGO only | VGO/HGO + LWP | VGO/HGO + LWP |
|---|---|---|---|---|
| Conversion (%) | 60 | 75 | 60 | 75 |
| Viscosity at 40° C. ($mm^2/s$) | 12.1 | 10.3 | 11.8 | 10.6 |
| Viscosity at 100° C. ($mm^2/s$) | 3.0 | 2.8 | 3.0 | 2.8 |
| Viscosity index | 105 | 109 | 103 | 109 |
| Pour point (° C.) | −33 | −33 | −33 | −33 |

In addition to the two heavier product fractions, the middle distillate fraction (185-360° C.) was analysed in a different manner. The results, which are presented in Table 4, show that addition of LWP decreased the density and increased the cetane number of this product. Thus, in certain aspects the LWP-containing product can be considered to have better properties for e.g. use as a diesel fuel component.

TABLE 4

Properties of the 185-350° C. fraction at different conversion levels with VGO only and VGO + LWP.

| Feed | Method | VGO/HGO only | VGO/HGO only | VGO/HGO + LWP | VGO/HGO + LWP |
|---|---|---|---|---|---|
| Density (kg/m$^3$, 15° C.) | ENISO12185 | 823.2 | 822.9 | 827.1 | 820.2 |
| Sulphur content (mg/kg) | ASTM D7039 | 3.6 | 3.3 | 3.3 | 5.1 |
| Aromatics (wt. %) | EN12916 | 5.4 | 4.8 | 5.6 | 4.8 |
| Cetane number | ASTM D6890 | 51.5 | 51.3 | 53.1 | 54.4 |

It will be obvious to a person skilled in the art that, as the technology advances, the inventive concept can be implemented in various ways. The invention and its embodiments are not limited to the examples described above but may vary within the scope of the claims.

The invention claimed is:

1. A method of upgrading liquefied waste plastic (LWP) to a mixture of purified hydrocarbons, the method comprising:

providing a feed containing liquefied waste plastic (LWP), and containing a vacuum gas oil (VGO) stream and/or a heavy gas oil (HGO) stream to form a mixed stream;

subjecting said mixed stream to hydrotreatment for removal of impurities and to produce a hydrotreated stream;

subjecting the hydrotreated stream to hydrocracking to produce a hydrocracked stream containing a mixture of purified hydrocarbons; and fractionating the hydrocracked stream containing a mixture of purified hydrocarbons.

2. The method according to claim 1, wherein the mixed stream comprises:

1 to 40 wt. % LWP, 5 to 30 wt. % LWP, or 5 to 25 wt. % LWP based on a total of the mixed stream, and a balance of the stream being VGO and/or HGO.

3. The method according to claim 1, wherein the LWP is produced as pyrolyzed waste plastic.

4. The method according to claim 3, wherein the pyrolyzed waste plastic is fractionated to one or more LWP fractions, and at least one of the LWP fractions is in the feed to be hydrotreated.

5. The method according to claim 1, wherein the LWP is subjected to pre-treatment before the hydrotreatment.

6. The method according to claim 1, wherein the hydrotreatment comprises:

use of at least one guard bed before hydrotreating the mixed stream.

7. The method according to claim 1, wherein the hydrotreatment and hydrocracking are performed in one unit, arranged in one vessel having a hydrotreatment section followed by a hydrocracking section.

8. The method according to claim 1, wherein the hydrotreatment is performed in a presence of a catalyst selected from sulfided NiMo, CoMo and a combination thereof, on alumina ($Al_2O_3$) support.

9. The method according to claim 1, wherein the hydrotreatment is performed under conditions that include:

a temperature of 250-450° C., 330-420° C., or 390-410° C.;

a pressure of 30-250 bar, 130-180 bar, or 145-155 bar;

a hydrogen to oil volume ratio of 500-2000 L:L, about 900-1300 L:L, or about 1000-1200 L:L; and a hydrocarbon liquid hourly space velocity (LHSV) of about 0.2 to 10.0 L/h, 1.5 to 2.7 L/h, and/or 1.8-2.5 L/h.

10. The method according to claim 1, wherein the hydrocracking is performed in a presence of a bifunctional catalyst comprising:

an acidic support and an active hydrogenation component, the acidic support being alumina, amorphous silica-alumina or a zeolite, and the active hydrogenation component being NiMo, NiW, Pd or Pt.

11. The method according to claim 1, wherein the hydrocracking is performed under conditions which include:

a temperature of 250-450° C., 370-420° C., or 390-410° C.;

a pressure of 50-250 bar, 140-160 bar, or 145-155 bar;

a hydrogen to oil volume ratio of 500-2000 L:L, about 900-1300 L:L, or 1000-1200 L:L; and a hydrocarbon liquid hourly space velocity (LHSV) of about 0.5 to 5.0 L/h, 1.0 to 2.5 L/h, or 1.4 to 1.9 L/h.

12. The method according to claim 1, wherein the fractionating of the hydrocracked stream comprises:

performing a mixture of purified hydrocarbons such that at least two fractions are formed as a lighter and as a heavier fraction.

13. The method according to claim 1, comprising:

performing the fractionating such that at least three fractions are formed, of which a first heavier fraction is a fraction with components having a 5 wt. % distillation point of >380° C. and a second heavier fraction is a fraction with components having a 5 to 95 wt. % distillation range from 330 to 410° C., and a third fraction has a 95 wt. % distillation point of <370° C.

14. The method according to claim 1, comprising:

hydroisomerisation of the produced mixture of purified hydrocarbons either before the step of fractionating the produced mixture of purified hydrocarbons or after the step of fractionating the produced mixture of purified hydrocarbons.

* * * * *